US011817648B2

(12) United States Patent
Tiemann et al.

(10) Patent No.: US 11,817,648 B2
(45) Date of Patent: Nov. 14, 2023

(54) HOLDING FRAME FOR A PLUG CONNECTOR AND METHODS OF POPULATING SAME

(71) Applicant: HARTING Electric GmbH & Co. KG, Espelkamp (DE)

(72) Inventors: Andre Tiemann, Bad Essen (DE); Heiko Meier, Minden (DE); Andre Beneke, Vechta (DE); Jörg Ziegenhahn, Büren (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 586 days.

(21) Appl. No.: 16/606,664

(22) PCT Filed: Apr. 11, 2018

(86) PCT No.: PCT/DE2018/100331
§ 371 (c)(1),
(2) Date: Oct. 7, 2021

(87) PCT Pub. No.: WO2018/192617
PCT Pub. Date: Oct. 25, 2018

(65) Prior Publication Data

US 2022/0029346 A1 Jan. 27, 2022

(30) Foreign Application Priority Data

Apr. 20, 2017 (DE) ..... 10 2017 108 433.9

(51) Int. Cl.
*H01R 13/518* (2006.01)
*H01R 13/506* (2006.01)
(Continued)

(52) U.S. Cl.
CPC ..... *H01R 13/518* (2013.01); *H01R 13/506* (2013.01); *H01R 13/514* (2013.01); *H01R 13/6275* (2013.01); *H01R 13/745* (2013.01)

(58) Field of Classification Search
CPC .. H01R 13/506; H01R 13/508; H01R 13/514; H01R 13/518; H01R 13/6275; H01R 13/745
See application file for complete search history.

(56) References Cited

U.S. PATENT DOCUMENTS 3,547,274 A * 12/1970 Sosinkski ..... H02B 1/052 248/314
3,559,813 A 2/1971 Sosinski
(Continued)

FOREIGN PATENT DOCUMENTS

CN 1989658 A 6/2007
CN 20377786 U 11/2013
(Continued)

OTHER PUBLICATIONS

International Search Report and Written Opinion, dated Jul. 11, 2018, for International Application No. PCT/DE2018/100331, 13 pages (with English translation of Search Report).
(Continued)

*Primary Examiner* — Oscar C Jimenez
(74) *Attorney, Agent, or Firm* — SEED IP LAW GROUP LLP

(57) ABSTRACT

The present invention relates to the field of holding frames (1, 2, 3, 4, 5, 6, 7) for modules (9) and in particular of holding frames (1, 2, 3, 4, 5, 6, 7) for a plug connector for receiving similar and/or different modules (9). In order to provide a holding frame (1, 2, 3, 4, 5, 6, 7) that can be populated in an installed state with little of no additional
(Continued)

Figure 1:
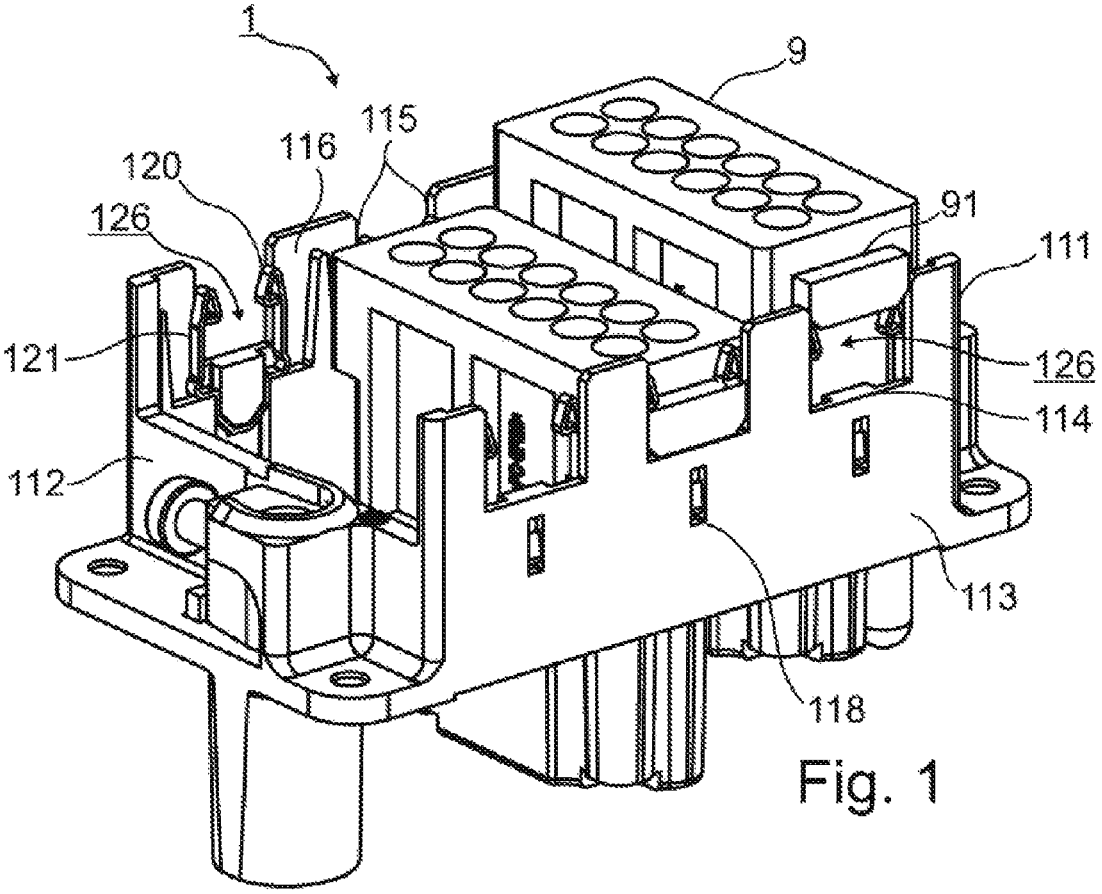

space around the holding frame (1, 2, 3, 4, 5, 6, 7), a base frame (111, 211, 311, 411, 511, 611, 711) which defines a plane transverse to an insertion direction of the module (9) into the holding frame (1, 2, 3, 4, 5, 6, 7) and which has mutually opposite end faces (112, 212, 312, 412, 512, 612, 712) and mutually opposite side walls (113, 213, 313, 413, 513, 613, 713) is proposed, as is a fixing member (120, 220, 320, 420, 520, 620, 720) which is attached to a side wall (113, 213, 313, 413, 513, 613, 713) of the base frame (111, 211, 311, 411, 511, 611, 711) and which allows deformation between an insertion state that allows the module (9) to be inserted into the holding frame (1, 2, 3, 4, 5, 6, 7) in the insertion direction and a holding state in which an inserted module (9) is fixed in place, along the insertion direction at least, by a latching lug (91) of the module (9) and by the fixing member (120, 220, 320, 420, 520, 620, 720), wherein the fixing member (120, 220, 320, 420, 520, 620, 720) is so designed that the deformation includes movement of at least one fixing arm (121, 221, 321, 421, 521, 621, 721) of the fixing member (120, 220, 320, 420, 520, 620, 720) in the longitudinal direction of the side wall (113, 213, 313, 413, 513, 613, 713).

7 Claims, 8 Drawing Sheets

(51) Int. Cl.

| | |
|---|---|
| ***H01R 13/514*** | (2006.01) |
| ***H01R 13/627*** | (2006.01) |
| ***H01R 13/74*** | (2006.01) |

(56) References Cited

U.S. PATENT DOCUMENTS

| | | | | |
|---|---|---|---|---|
| 3,576,520 | A | 4/1971 | Stauffer | |
| 4,032,209 | A | 6/1977 | Rutkowski | |
| 5,595,507 | A | 1/1997 | Braun et al. | |
| 5,795,174 | A | 8/1998 | Saito et al. | |
| 6,004,162 | A | 12/1999 | Harting et al. | |
| 6,094,785 | A * | 8/2000 | Montgomery | B25B 31/00 24/324 |
| 7,303,446 | B2 | 12/2007 | Hills et al. | |
| 7,316,591 | B2 | 1/2008 | Ferderer | |
| 7,591,677 | B2 | 9/2009 | Bade et al. | |
| 8,512,067 | B2 | 8/2013 | Denter et al. | |
| 9,257,788 | B1 | 2/2016 | Jia | |
| 9,356,390 | B2 | 5/2016 | Annis et al. | |
| 9,502,813 | B2 | 11/2016 | Dugo | |
| 9,720,195 | B2 | 8/2017 | Giraud et al. | |
| 10,177,484 | B2 | 1/2019 | Schönfeld et al. | |
| 10,276,965 | B2 | 4/2019 | Herbrechtsmeier et al. | |
| 10,283,900 | B2 | 5/2019 | Herbrechtsmeier et al. | |
| 10,333,244 | B2 | 6/2019 | Herbrechtsmeier et al. | |
| 10,340,624 | B2 | 7/2019 | Schönfeld et al. | |
| 10,396,488 | B2 | 8/2019 | Wölffle | |
| 10,418,773 | B2 | 9/2019 | Herbrechtsmeier | |
| 10,530,090 | B2 | 1/2020 | Wolff et al. | |
| 10,559,911 | B2 | 2/2020 | Herbrechtsmeier | |
| 10,665,981 | B2 | 5/2020 | Mossig et al. | |
| 10,665,982 | B2 | 5/2020 | Herbrechtsmeier et al. | |
| 10,686,278 | B2 | 6/2020 | Herbrechtsmeier et al. | |
| 10,756,475 | B2 | 8/2020 | Tiemann et al. | |
| 10,892,572 | B2 | 1/2021 | Diessel et al. | |
| 11,038,304 | B2 | 6/2021 | Tiemann et al. | |
| 11,289,847 | B2 | 3/2022 | Best | |
| 2006/0019548 | A1 | 1/2006 | Baker et al. | |
| 2007/0155252 | A1 | 7/2007 | Ferderer | |
| 2020/0059034 | A1 * | 2/2020 | Tiemann | H01R 13/518 |
| 2020/0251849 | A1 | 8/2020 | Tiemann et al. | |
| 2020/0295500 | A1 * | 9/2020 | Tiemann | H01R 13/518 |
| 2022/0029346 | A1 | 1/2022 | Tiemann et al. | |

FOREIGN PATENT DOCUMENTS

| | | | |
|---|---|---|---|
| CN | 203326246 | U | 12/2013 |
| CN | 205609835 | U | 9/2016 |
| CN | 205680860 | U | 11/2016 |
| CN | 206098894 | U | 4/2017 |
| DE | 20 2010 009 199 | U1 | 9/2010 |
| DE | 10 2013 113 976 | A1 | 6/2015 |
| DE | 20 2015 106 434 | U1 | 4/2017 |
| EP | 0 860 906 | A2 | 8/1998 |
| EP | 1 801 927 | A1 | 6/2007 |
| EP | 2 312 700 | A1 | 4/2011 |
| EP | 2 581 991 | A2 | 4/2013 |
| EP | 2 945 229 | A1 | 11/2015 |
| JP | 8-273753 | A | 10/1996 |
| JP | 2010-80083 | A | 4/2010 |
| WO | 2014/155171 | A1 | 10/2014 |
| WO | 2016/150565 | A1 | 9/2016 |
| WO | 2017/036928 | A1 | 3/2017 |

OTHER PUBLICATIONS

International Search Report and Written Opinion, dated Jul. 3, 2018, for International Application No. PCT/DE2018/100330, 18 pages (with English machine translation of Search Report).

* cited by examiner

HOLDING FRAME FOR A PLUG CONNECTOR AND METHODS OF POPULATING SAME

The present invention relates to the field of holding frames for modules and in particular of holding frames for a plug connector for receiving similar and/or different modules.

Holding frames are used to accommodate a plurality of similar and/or different modules. These modules may be insulating bodies, for example, which are provided as contact holders for electronic and electrical and possibly also for optical and/or pneumatic contacts.

A holding frame for holding plug connector modules and for installing in plug connection casings or for screwing onto wall surfaces is known from document EP 0 860 906 B1, wherein the plug connector modules are inserted into the holding frame and holding means on the plug connector modules cooperate with recesses provided on opposite wall parts (side parts) of the holding frame, wherein the recesses in the form of openings which are bounded on all sides are provided in the side parts of the holding frame, wherein the holding frame consists of two halves articulatedly connected to each other, wherein the holding frame separates along a line which is parallel to the side parts of the holding frame, and wherein hinges are arranged in fastening ends of the holding frame in such a way that when the holding frame is screwed onto a fastening surface, the frame parts are oriented in such a way that the side parts of the holding frame are oriented at right angles to the fastening surface and the plug connector modules are connected interlockingly to the holding frame by means of the holding means. In practice, such holding frames are normally made in a die casting process, and more particularly in a zinc die casting process.

Document EP 2 581 991 A1 discloses a holding frame for plug connector modules, comprising two frame halves which can be latched to each other by linear displacement of the one frame half relative to the other frame half in a sliding direction, wherein mutually corresponding latching means are provided on the frame halves and cause the two frame halves to latch into each other in two different latching positions during linear displacement, in which the frame halves are spaced from each other at different distances.

Practice has shown, however, that assembling such holding frames is a time-consuming operation. For example, such holding frames have to be screwed and/or latched out of the plug connector as soon as just one single module needs replacing. It is possible that the other modules, whose removal is not at all desired, could fall out of the holding frame and have to be inserted again before the frame halves are screwed together again and/or before the frame halves latch together. Before the frame halves can be joined, all the modules must simultaneously be in the position provided for them, so that they can finally be fixed in place in the holding frame when the frame halves are joined together. This makes assembly more difficult.

Document EP 1 801 927 B1 discloses a holding frame consisting of an integral injection-moulded plastic part. The holding frame is formed as a circumferential collar and on its mating side has a plurality of wall segments which are separated by slits. A respective pair of opposite wall segments form an insertion region for a plug-in module, the wall segments having window-like apertures for receiving projections integrally moulded with the narrow sides of the modules. A guide groove is also provided in each of the wall segments. The guide groove is formed above the apertures by means of an outwardly offset window web which has an insertion bevel on the inner surface. The plug-in modules also have latching arms integrally moulded on the narrow sides, which act in the direction of the cable connectors, and which latch into place under the lateral collar wall, so that two independent latching means fix the plug connector module in the holding frame.

One disadvantage of this prior art is that it is a holding frame made of plastic, which is generically unsuitable for protective earthing according to the EN 61984 standard for connectors, which therefore means that such a holding frame cannot be used for installation in metal plug connector casings. The use of metal plug connector casings requires such protective earthing, however, and in many cases is necessary and therefore desired by customers because of the mechanical robustness, temperature resistance and electrical shielding properties of such casings. It has also been found that manufacturing the aforementioned plastic holding frames by injection moulding is difficult at the least and can only be achieved with great effort and expenditure. Finally, the heat resistance of such a plastic holding frame is not always sufficient for special applications, either, for example near a blast furnace.

In order to specify a structural design for a holding frame which has good heat resistance and high mechanical robustness and which allows protective earthing, also and in particular when installed in a metal plug connector casing, and which also ensures ease of operation, especially when replacing individual modules, document DE 10 2013 113 976 A1 proposes providing a base section (preferably die cast and made of zinc or aluminium or an appropriate alloy, for example) for fixing a received module in a plane, and a deformation section (preferably a die formed resilient metal sheet) which can adopt an insertion state and a holding state, the insertion state allowing at least one module to be inserted into the holding frame in a direction transverse to the plane, and a received module being fixed in place in the holding state. The base section and the deformation section are formed at least partly of different materials, in any case.

By dissociating the material properties of the base body from those of the deformation section, such a holding frame allows greater flexibility by using suitable combinations of materials.

In the holding frames described in DE 10 2013 113 976 A1, each deformation section is formed by flange parts attached to the outer face of a base frame, the flange parts each having a bending line in their lower end region, at which the flange parts are folded by 180° such that a final edge of the respective flange part is located within the base frame. In order to attach the flange part, the base frame has outer attachment studs with engage into matching attachment recesses when a flange part is attached.

The holding frames known from EP 0 860 906 B1 and EP 2 581 991 A1 do not allow insertion or removal of a module when the holding frame is in the installed state, because entire frame halves would have to moved in each case. Although this limitation does not apply to the holding frames known from EP 1 801 927 B1 and DE 10 2013 113 976 A1, the problem here is that, when modules are being inserted into or removed from the holding frames in the installed state, it is necessary to provide an installation space with a width greater than the width of the modules, that is, which is greater than the distance from the outer edges of the opposite latching lugs. EP 1 801 927 B1 and DE 10 2013 113 976 A1 each have boundaries for the latching windows that receive the latching lugs of the modules, which boundaries yield outwards in the width direction when a module is being inserted, so that the minimum amount of installation space required by the width of the module, plus the respective thicknesses of the latching window boundaries is provided, with additional space possibly being required due to pivoting movement during deformation.

One aim of the present invention is to provide a holding frame that allows a module to be inserted, and also removed, if necessary, while also requiring as little space as possible even when in the installed state.

It is therefore desired that a solution be presented which allows a holding frame in an installed state to be populated with a module when there is little or no additional space around the holding frame.

According to a first aspect of the invention, a holding frame for a plug connector for receiving similar and/or different modules is proposed, as defined in claim 1, namely a holding frame comprising a base frame which defines a plane transverse to an insertion direction of a module into the holding frame, and which has mutually opposite end faces and mutually opposite side walls, and a fixing member which is attached to a side wall of the base frame and which is designed for deformation between an insertion state which allows the module to be inserted into the holding frame in the insertion direction, and a holding state in which an inserted module is held in place, along the insertion direction at least, by a latching lug of the module and by the fixing member, wherein the fixing member is so designed that the deformation includes movement of at least one fixing arm of the fixing member in the longitudinal direction of the side wall.

According to a second aspect of the invention, a method of populating a holding frame for a plug connector for receiving similar and/or different modules with a module is proposed, as defined in claim 10, namely a method comprising the steps of inserting the module into a base frame which defines a plane transverse to an insertion direction of the module into the holding frame and which has mutually opposite end faces and mutually opposite side walls, wherein the insertion step includes passing a latching lug of the module past a section of a fixing arm of a fixing member, that is attached to a side wall of the base frame and that is designed to allow deformation between an insertion state which allows the module to be inserted into the holding frame, and a holding state in which an inserted module is held in place, along the insertion direction at least, by the latching lug of the module and by the fixing member, wherein the fixing member is in the insertion state for at least a moment during the passing step, wherein the method includes deforming the fixing member from the insertion state to the holding state and wherein deforming includes movement of at least the fixing arm of the fixing member in the longitudinal direction of the side wall.

Part of the background to the present invention can be found in the following considerations.

In the holding frames known from EP 0 860 906 B1 and EP 2 581 991 A1, the whole holding frame divided into parts yields to the modules or their latching lugs on insertion, in order to clear a path for the module to a position in which the module can be fixed in place by the holding frame when it returns to its holding state. The holding frames known from EP 1 801 927 B1 and DE 10 2013 113 976 A1 also involve similar yielding, but only of part of the holding frame, which can otherwise remain substantially in its installed state. What these approaches have in common, in any case, is that space is made by yielding outwards, which may mean that more space is commensurately required. The amount of space thus required can be lowered by reducing the thickness of the yielding element, although this means less stability and/or tougher demands with regard to material properties.

It has been realised in connection with the present invention that the path for the latching lug of a module can also be cleared by parts of the holding frame yielding laterally, that is, along a plane defined by the side wall of the holding frame, whereby such yielding does not involve any increased space being needed in the outward direction. Use is thus made here, to an extent, of the space that laterally surrounds the latching lug (in the plane of the side wall).

A basis for the holding frame according to the invention is formed by the rigid base frame, which serves as a stable framework. Spring clips, for example, are mounted in or on this base frame as fixing members that are securely connected to the base frame. When a module is pressed in, these spring clips (opposite one another) swing open to the side, allow the module (its latching lugs) to pass, and snap back as soon as the module has reached its final position in the holding frame. The module is now held in place between the legs of the spring clip. In holding frames known from the prior art, steel sheet members swing outwards away from the module, with the result that additional space besides the width of the module is needed. In this invention, the spring clip (as an example of a fixing member) does not swing outwards, away from the module, but laterally, i.e. at a right angle to the longitudinal direction of the module. In this way, no additional space is needed in the longitudinal direction of the module.

In one advantageous embodiment of one aspect of the invention, the fixing member includes a round or rectangular wire and/or an elastic plastic or spring steel strip.

Forming the fixing member, and in particular the fixing arm, out of a round or rectangular wire allows it to be manufactured in a simple and cost-efficient manner, with the wire being brought in a suitable manner into the shape required to perform its function. The wire itself preferably retains a degree of elasticity with which elastic deformation on insertion of the module is then assured. It is also possible to make the fixing member cost-efficiently by making it from an elastic plastic. The invention can also be realised with a suitably designed fixing member punched from sheet metal.

In another advantageous embodiment of the invention, the base frame has a stop for the latching lug in the direction of insertion.

By means of a stop, the spatial design of the base frame defines how the module is positioned inside the base frame (and thus inside the holding frame). The base frame itself can thus be used to take up loads from the module, for example loads resulting from pull on the module (e.g. when disconnecting a plug connection), without such loads acting on the fixing member.

In another advantageous embodiment of one aspect of the invention, the base frame has a guide for guiding the latching lug in the insertion direction when inserting the module.

Such guiding predefines the path of the module during insertion, so mistakes during insertion can be better prevented in this way. Due to the more stable base frame guiding the module, it is also possible to prevent operating errors causing damage to the fixing member.

When guides of different widths, for example, are provided on the opposite sides of the base frame, this can be utilised, in combination with the latching lugs on the module being designed accordingly, to provide reverse polarity protection, where a module can only be inserted into the holding frame with a predetermined orientation.

In another advantageous embodiment of one aspect of the invention, the fixing member is attached form-fittingly, force-lockingly and/or by material bonding to the inner face and/or to the outer face of the base frame, and/or to inside a side wall of the base frame, in particular by bonding, welding, soldering, riveting, snap-locking and/or screwing.

As long as the fixing member is attached sufficiently securely, the invention is not limited to a specific relative positioning of the fixing member in relation to the side wall, so it may be arranged inside (i.e. in the interior of the holding frame), outside or also in a cavity extending in the insertion direction, for example, inside the side wall, and combinations of the above may also be provided.

Depending on the design of the fixing member (with regard to the choice of material, for example), a suitable way of attaching it can be chosen, a form fit being specifically preferred here, because if skillfully designed it can be achieved with little effort when producing or assembling the holding frame.

In another advantageous embodiment of one aspect of the invention, the fixing member is mounted in a recess on the inner side of the side wall and is fixed in place in the direction of insertion by boundaries of the recess, wherein the fixing member also includes a clamping piece that extends through an opening in the side wall and/or around an edge of the side wall to the outer side of the side wall and with which the fixing member is secured against falling out of the recess.

Due to the fixing member being provided in a recess on the inner side of the side wall, the fixing member is well secured against external influences, particularly when a module is inserted. The recess also allows the base frame with its inner side surface to play the role of guiding the module in the transversal direction during insertion, so the fixing member is less exposed to the risk of damage as a result. There is also a form fit with the clamping piece, thus preventing movement transverse to the side wall, while the boundaries of the recess secure the fixing member against movement within a plane defined by the side wall.

In another advantageous embodiment of one aspect of the invention, the fixing member is clamped in place by means of a clamping section on the inner side of the side wall.

Alternatively or additionally to the previous embodiment, the fixing member may also be joined, by frictional engagement achieved by clamping, to a protrusion which projects as a clamping section from part of the inner side of the side wall. In one variant, the fixing member may extend around the protrusion, and in another, supplementary or alternative variant it may be arranged inside the protrusion (from a different perspective inside a recess).

However, it is also possible that part of the fixing member extends through an opening in the side wall and is clamped in that opening.

In another advantageous embodiment of one aspect of the invention, the fixing member is arranged with parts on the outer side of the side wall and with parts on the inner side of the side wall and is intertwined with at least a part of the base frame.

This variant, too, can be an alternative to the previous two variants, or may be combined with one or both of them.

In another advantageous embodiment of one aspect of the invention, the fixing arm has a fixing hook having a sloping face and a shoulder, wherein the sloping face is provided to come into contact with the latching lug of the module on insertion of the module, such that when the latching lug slides along the sloping face, the fixing arm is deformed in the direction of the insertion state, wherein the shoulder is designed to engage at least partly with the latching lug of an inserted module in the holding state.

Due to its spatial design, the shape of the fixing hook provides the desired cooperation between the fixing arm and the latching lug of the module on insertion of the module into the holding frame. The shoulder that preferably results from the sloping face ensures the form fit with the latching lug in a simple manner.

In another advantageous embodiment of one aspect of the invention, the fixing arm has a manipulation member that projects beyond an upper edge of the base frame and/or of an inserted module and allows the fixing arm to be manually deformed.

When the fixing arm extends so far that it can be accessed by a user even when the module is inserted and fixed in place, this can allow a module to be removed again from the holding frame, even without any further tools or the like, by the user using the manipulation member to bring the fixing arm into the insertion state in which the module can then be removed.

In another advantageous embodiment of one aspect of the invention, the fixing member is designed to fix the module in the holding state by form-locking engagement between the fixing arm and the latching lug of the module.

Even though the invention is not limited to fixing or holding the module by form-locking engagement between the fixing member (especially the fixing arm) and the latching lug, which means that frictional engagement or some other force-fit connection may be provided, for example, it is preferable to use form-locking engagement due to the associated reliability and the possibility of using a relatively simple constructional design.

In another advantageous embodiment of one aspect of the invention, the fixing member is designed to be elastically deformed between an insertion state and a holding state.

Elastic deformation means that, when the force acting on the fixing member and causing deformation from the holding state to the insertion state (e.g. the force produced on insertion by displacement of the fixing arm(s) by the latching lug(s) of the module) is no longer present, the fixing member itself ensures that it returns to the holding state. However, it may be also be envisaged that the deformation is plastic deformation, as long as sufficient reversibility of that deformation remains assured, to allow a desired number of module insertion/removal cycles.

In another advantageous embodiment of one aspect of the invention, the fixing member has two fixing arms between which there is a latching area for receiving a latching lug of a module.

The invention can basically be realised by providing a fixing arm as part of a fixing member, particularly whenever a secure form fit between the latching lug and the fixing arm can be achieved by a combination of factors in the geometric design of the base frame (for example with a stop and a guide). However, if two fixing arms are provided that enclose the latching lug of an inserted module between each other in the holding state, the same degree of form-locking engagement can be achieved with a reduced amount of deformation per fixing arm.

The invention is not limited, either, to a fixing member with two fixing arms, because one fixing member may also have several fixing arms within the scope of the invention, one or two each of which are provided to hold a latching lug of a module in the holding state.

As an alternative to two fixing arms of a fixing member being jointly provided to hold a latching lug of a module, two otherwise separated fixing members may also interact, with a fixing arm of the one fixing member jointly defining, with a fixing arm of the other fixing member, the latching area for receiving the latching lug.

In another advantageous embodiment of one aspect of the invention, two fixing members are provided opposite one another on the two side walls for fixing a module in place with opposite latching lugs, a plurality of fixing members preferably being provided one beside the other in the longitudinal direction of the side walls. It is particularly preferred that the holding frame is fitted throughout, for all module slots provided to receive an inserted module, with fixing members on the side walls on the respective opposite sides.

In another advantageous embodiment of one aspect of the invention, the base frame, on the one hand, and the fixing member, on the other hand, are made at least partly of different materials.

The base frame and the fixing member(s) perform different functions in the context of the invention. The base frame should preferably determine the general stiffness of the holding frame to a substantial extent, whereas the fixing member(s) should be as easily and preferably elastically deformable as possible. These different functions can be best achieved by selecting separate and appropriate materials for the base frame and the fixing member(s) largely independently of each other.

In another advantageous embodiment of one aspect of the invention, the base frame is made at least partly by die casting, in particular of a metal, preferably of zinc or aluminium, or of a metal alloy, preferably of a zinc or aluminium alloy.

Prior art approaches and techniques for producing conventional base frames can also be utilised for base frames used in connection with the present invention, providing the shapes of such base frames are geometrically adapted in an appropriate manner.

Features of advantageous embodiments of the invention are defined in the dependent claims, in particular, and a person skilled in the art can also find other advantageous features, embodiments and variants of the invention in the above description and the discussion below.

Figure 2:
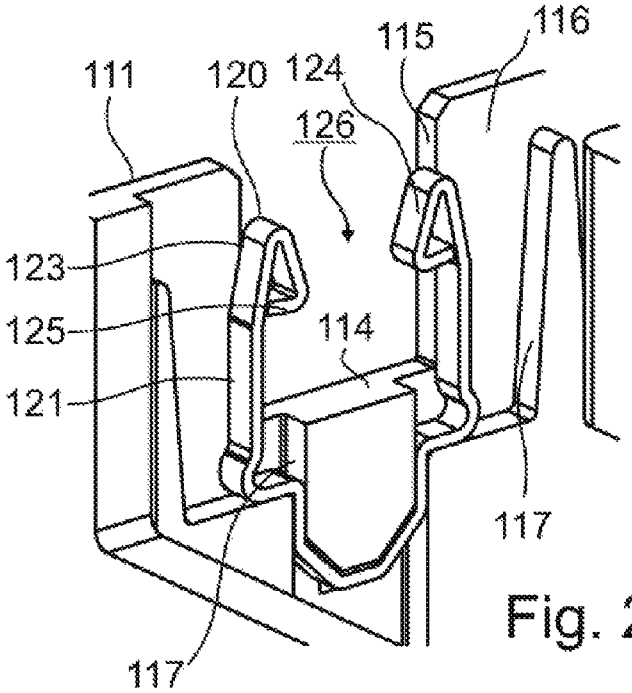
Figure 3:
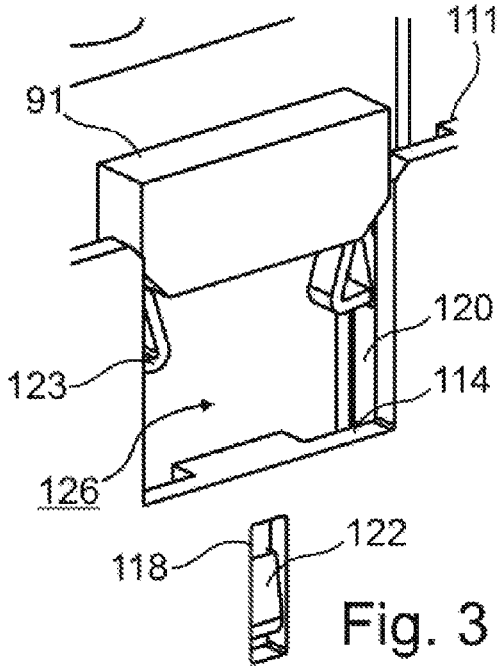
Figure 4:
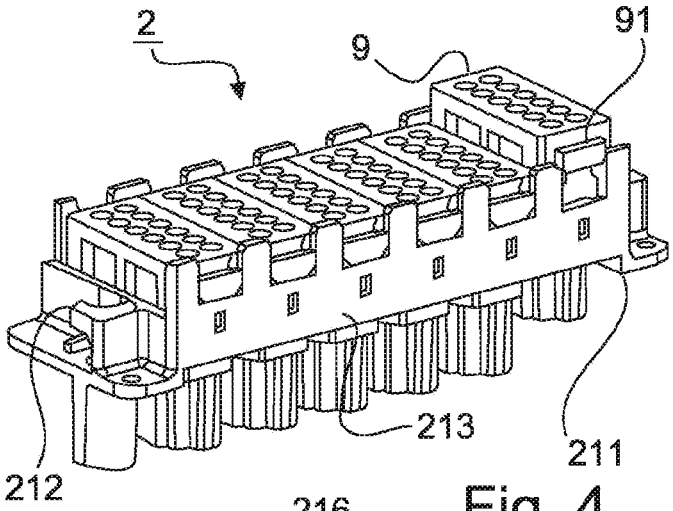
Figure 5:
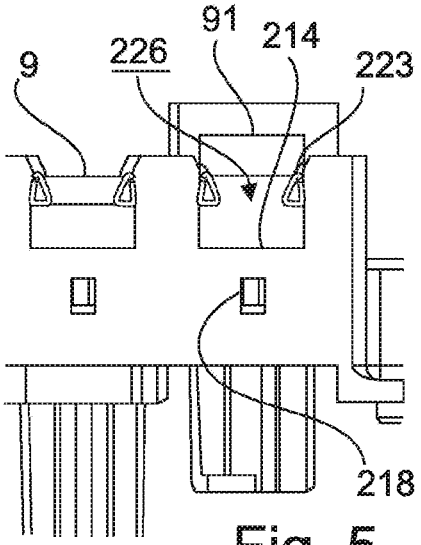
Figure 6:
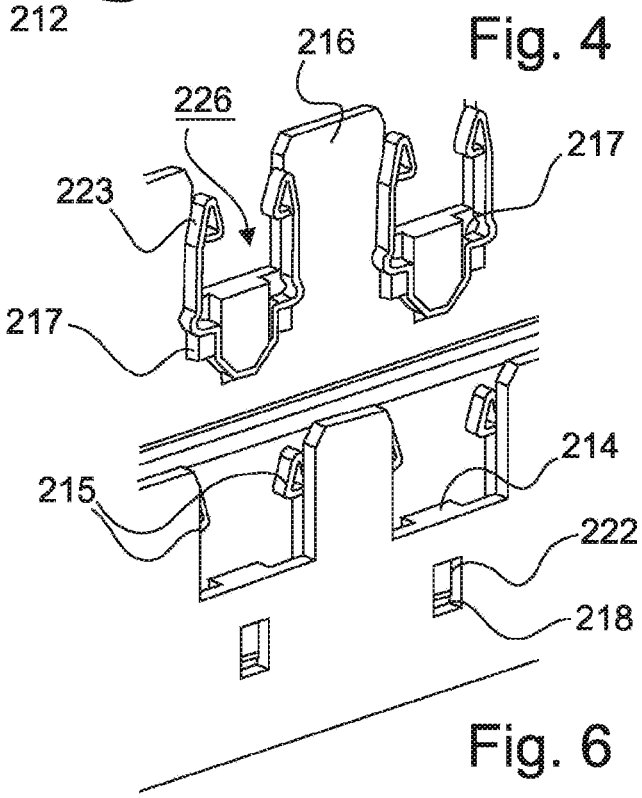
Figure 7:
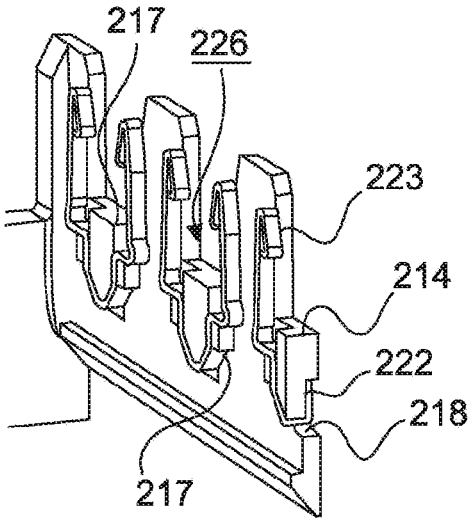
Figure 8:
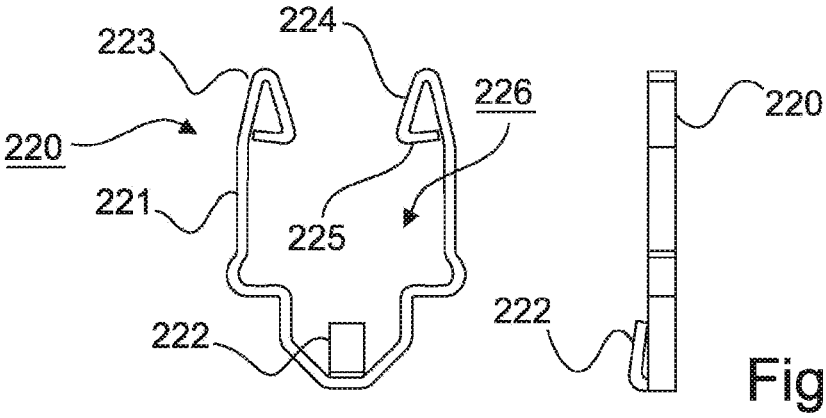
Figure 9:
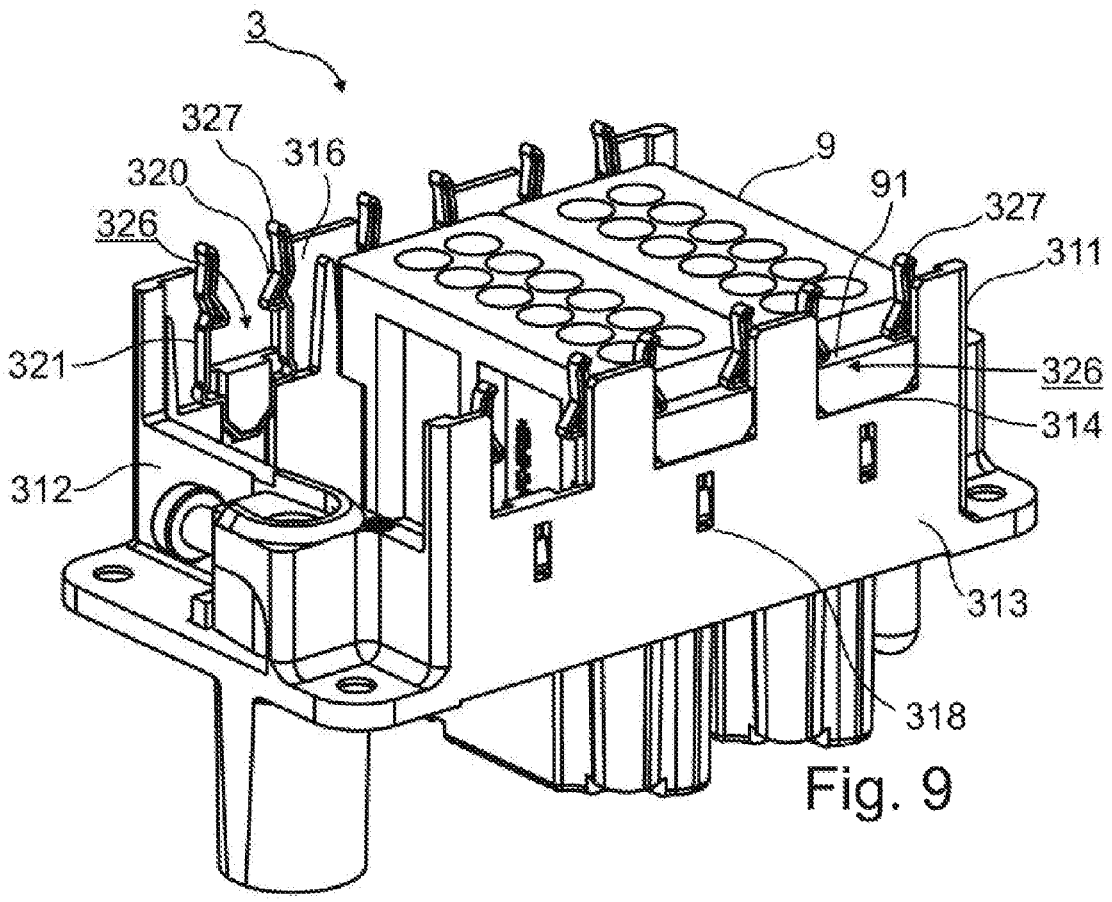
Figure 10:
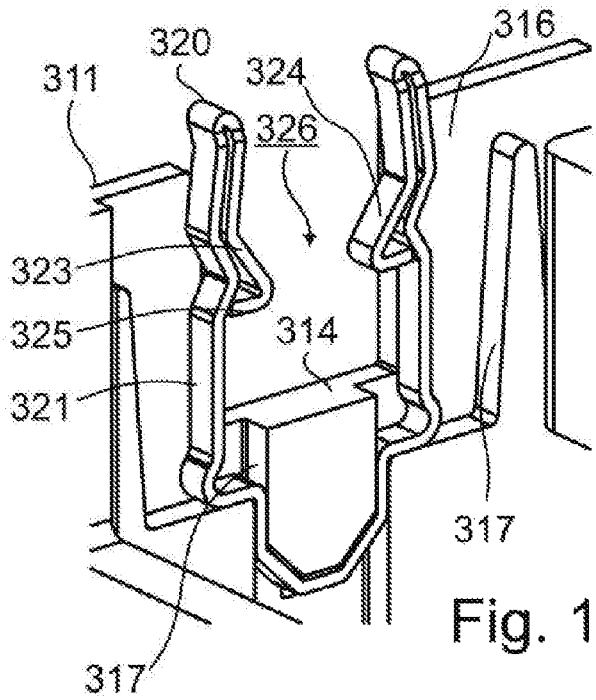
Figure 11:
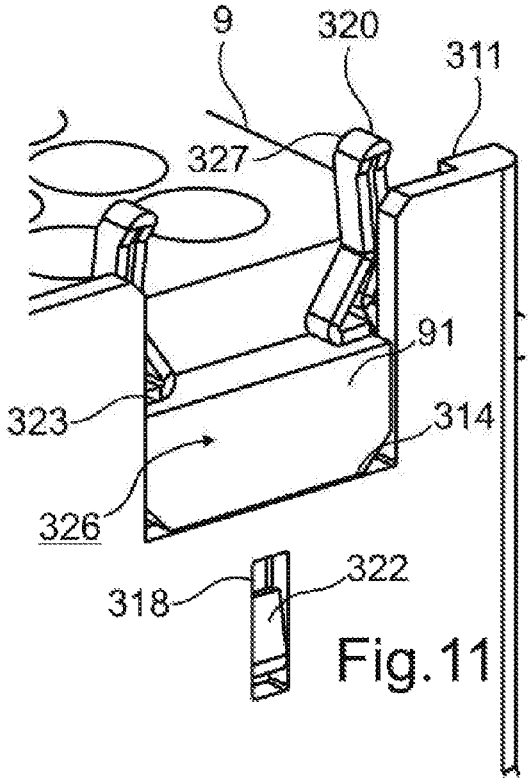
Figure 12:
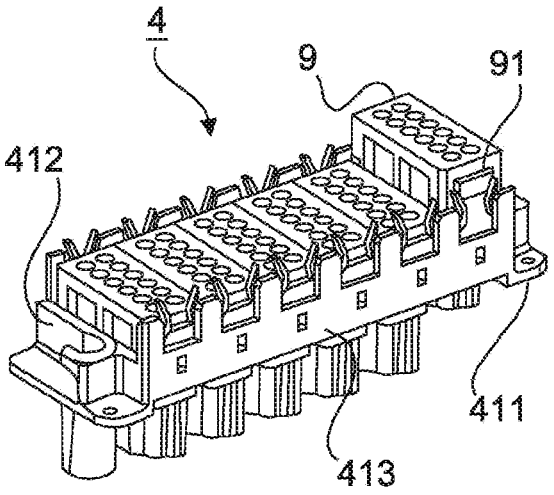
Figure 13:
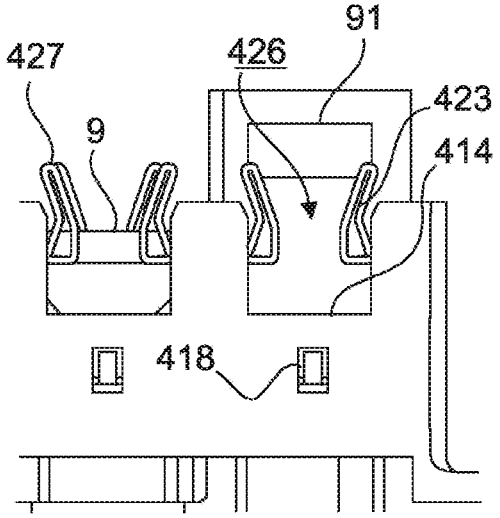
Figure 14:
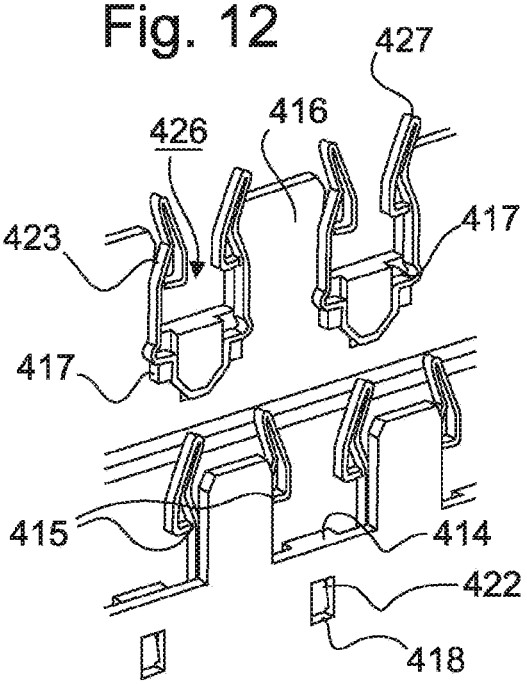
Figure 15:
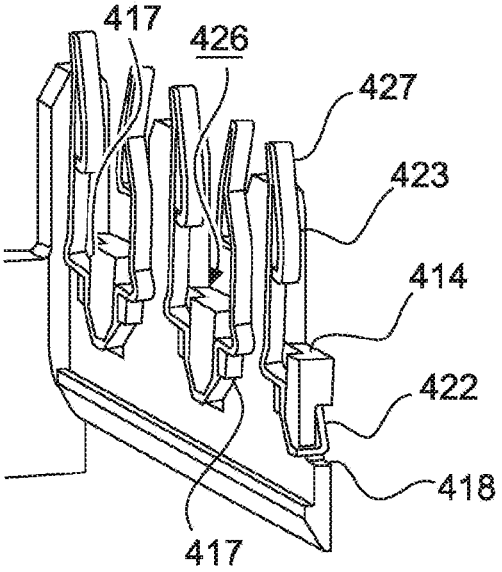
Figure 16:
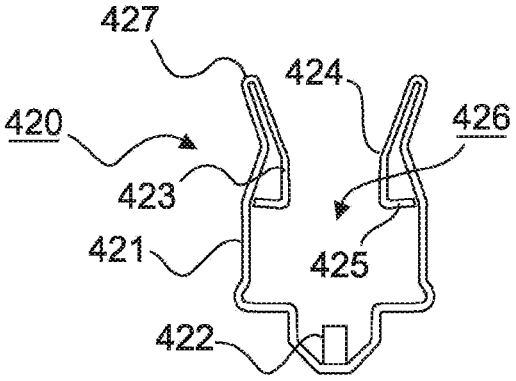
Figure 16:
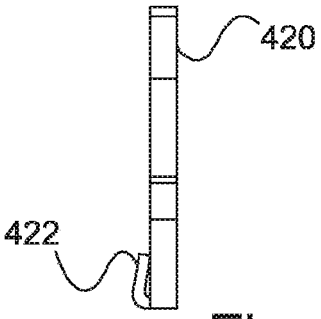
Figure 17:
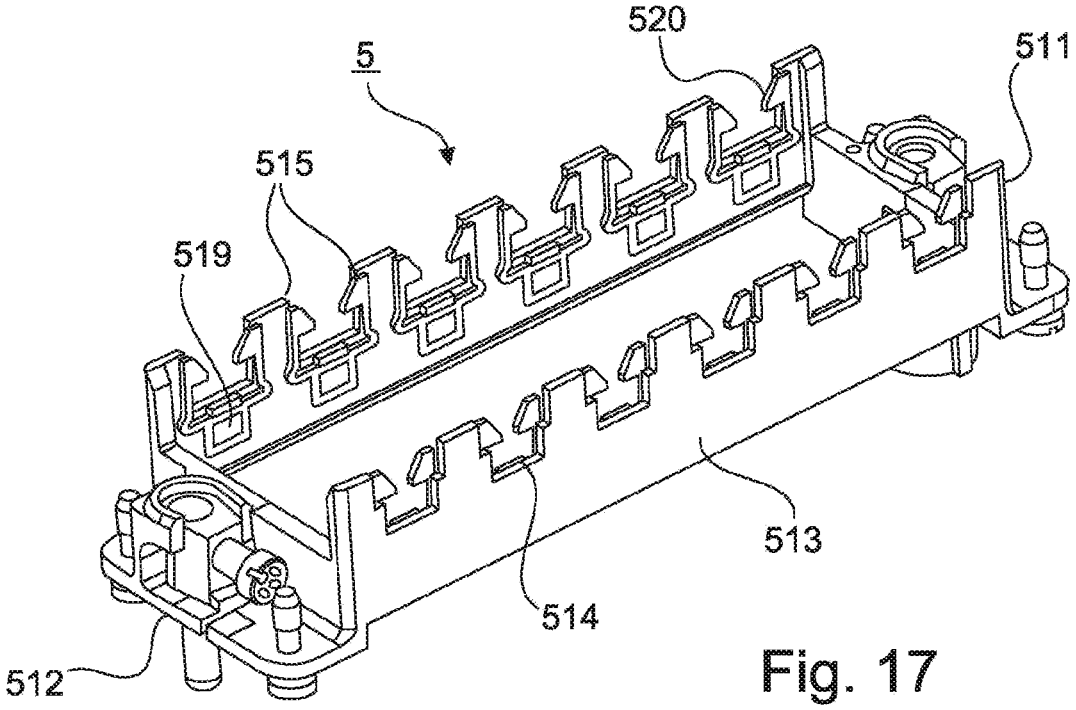
Figure 18:
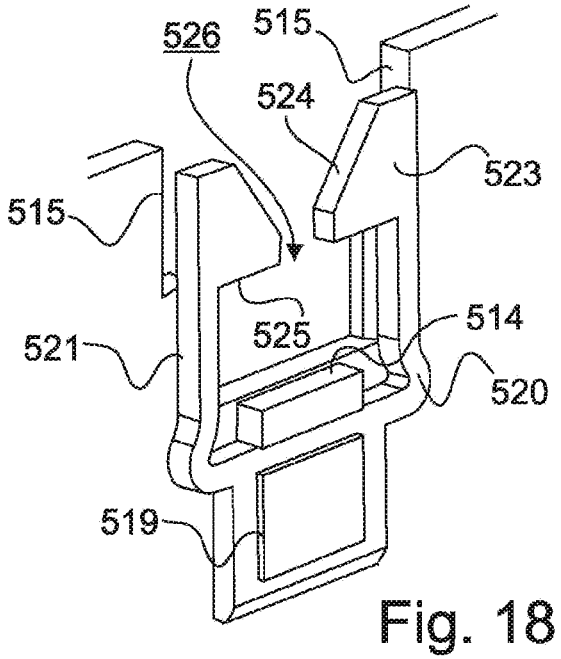
Figure 19:
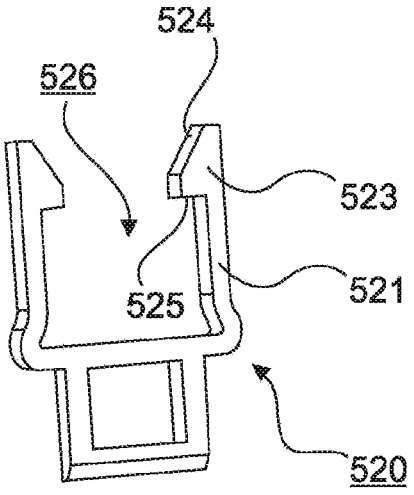
Figure 20:
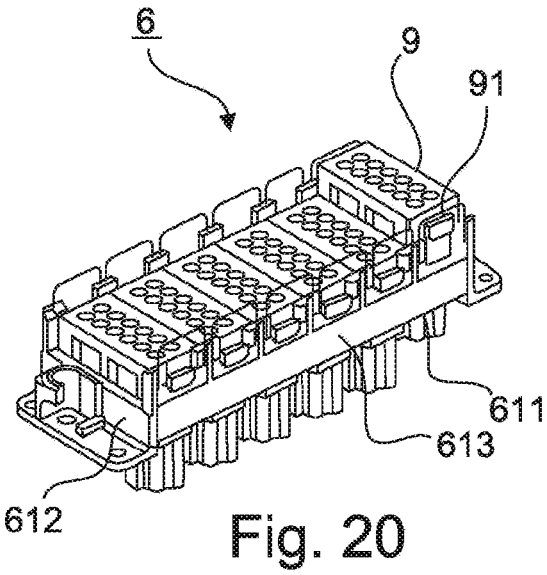
Figure 21:
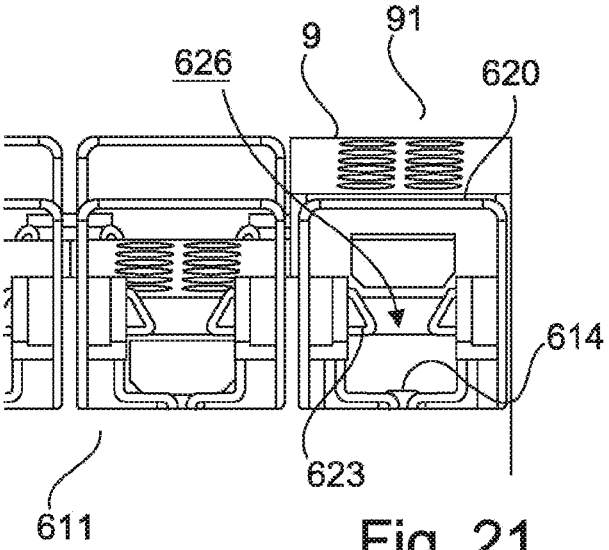
Figure 22:
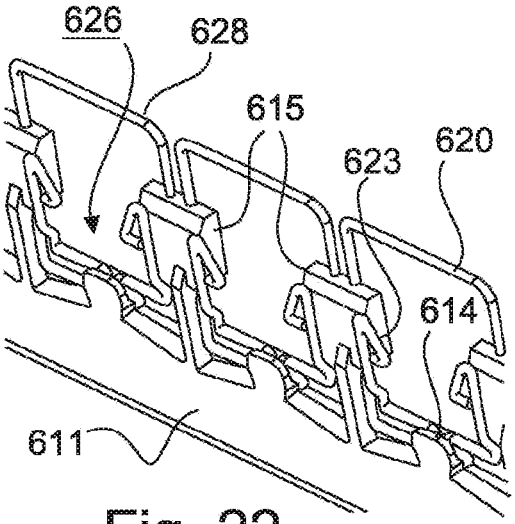
Figure 23:
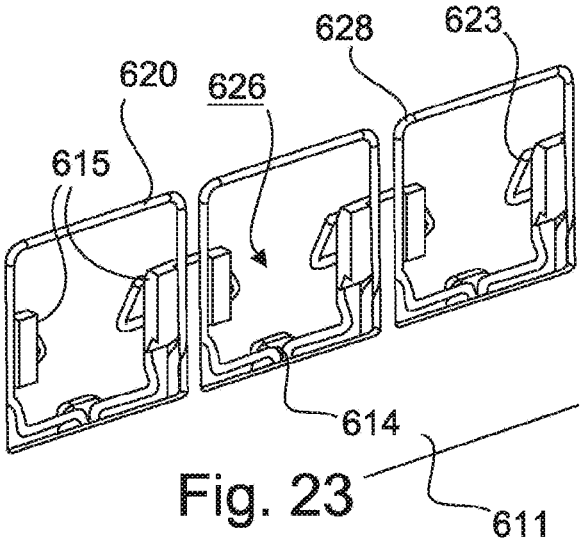
Figure 24:
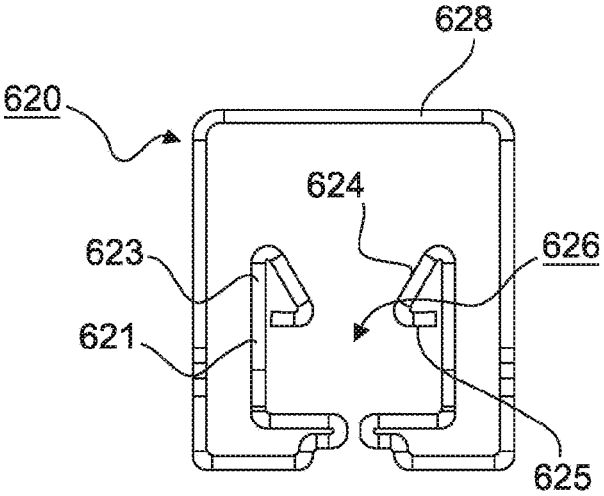
Figure 24:
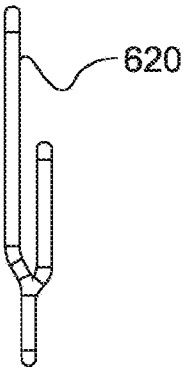
Figure 25:
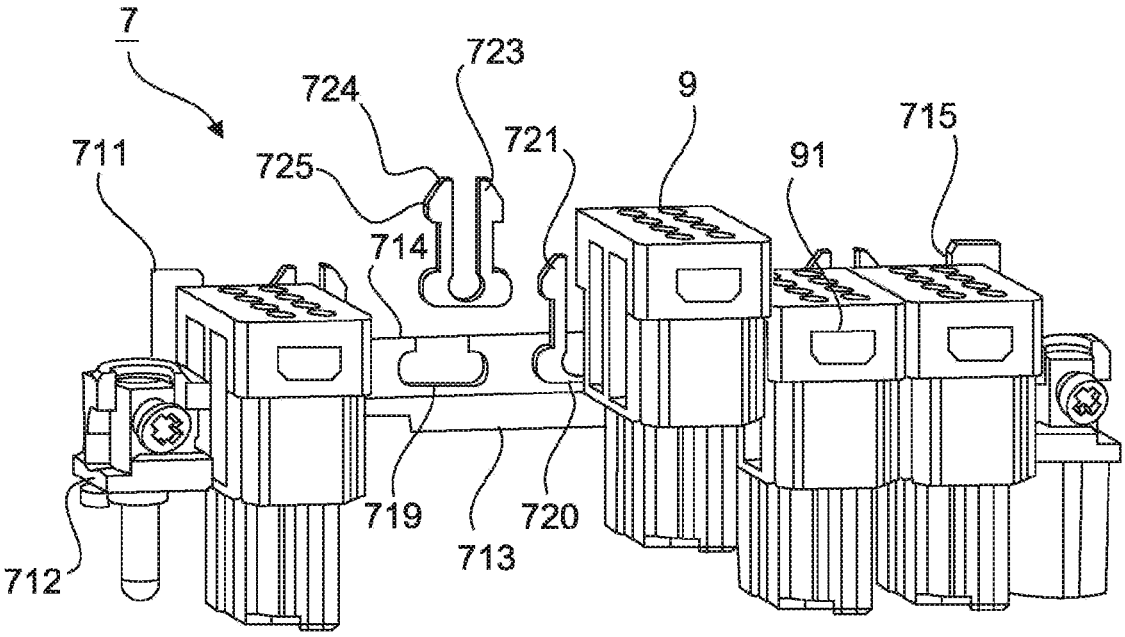
Figure 26:
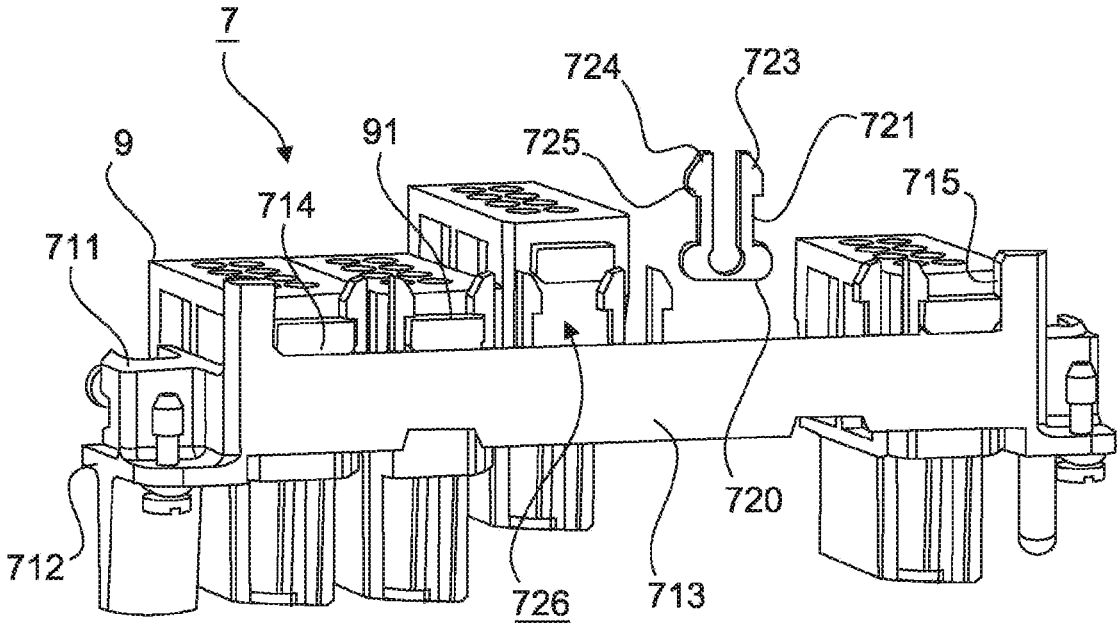
Figure 27:
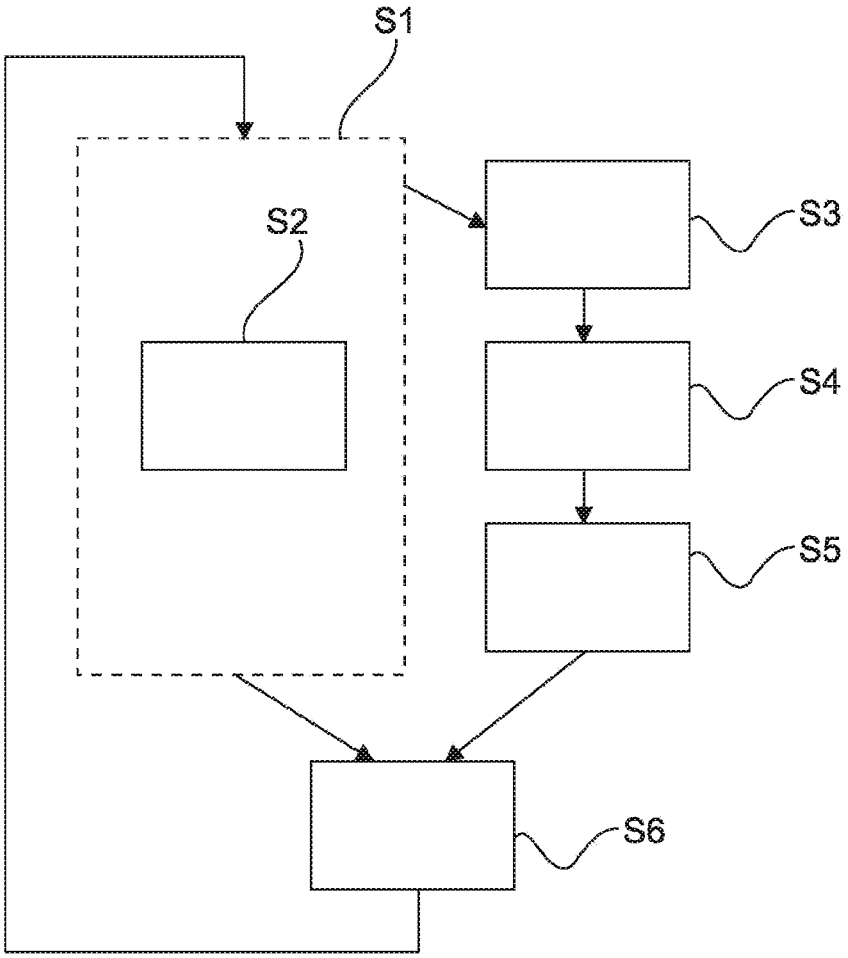

In the following, the present invention shall be illustrated and described with reference to the embodiments shown in the Figures, in which FIG. 1 shows a view of a holding frame according to a first embodiment of the invention, with modules, FIG. 2 shows an enlarged detail of the view shown in FIG. 1, FIG. 3 shows another enlarged detail of the view shown in FIG. 1, FIG. 4 shows a view of a holding frame according to a second embodiment of the invention, with modules, FIG. 5 shows a side view of a detail of the holding frame shown in FIG. 4, FIG. 6 shows an enlarged view of the holding frame shown in FIG. 4, without modules, FIG. 7 shows a partial cross-sectional view of the holding frame shown in FIG. 4, without modules, FIG. 8 shows two views of a fixing member of the holding frame shown in FIG. 4, FIG. 9 shows a view of a holding frame according to a third embodiment of the invention, with modules, FIG. 10 shows an enlarged detail of the view shown in FIG. 9, FIG. 11 shows another enlarged detail of the view shown in FIG. 9, FIG. 12 shows a view of a holding frame according to a fourth embodiment of the invention, with modules, FIG. 13 shows a side view of a detail of the holding frame shown in FIG. 12, FIG. 14 shows an enlarged view of the holding frame shown in FIG. 12, without modules, FIG. 15 shows a partial cross-sectional view of the holding frame shown in FIG. 12, without modules, FIG. 16 shows two views of a fixing member of the holding frame shown in FIG. 12, FIG. 17 shows a view of a holding frame according to a fifth embodiment of the invention, FIG. 18 shows an enlarged detail of the view shown in FIG. 17, FIG. 19 shows a view of a fixing member of the holding frame shown in FIG. 17, FIG. 20 shows a view of a holding frame according to a sixth embodiment of the invention, with modules, FIG. 21 shows a side view of a detail of the holding frame shown in FIG. 20, FIG. 22 shows enlarged view of the holding frame shown in FIG. 20, without modules, FIG. 23 shows another enlarged view of the holding frame shown in FIG. 20, without modules, FIG. 24 shows two views of a fixing member of the holding frame shown in FIG. 20, FIG. 25 shows a partial cross-sectional view of a holding frame according to a seventh embodiment of the invention, with modules, FIG. 26 shows another partial cross-sectional view of the holding frame shown in FIG. 25, and FIG. 27 shows a schematic flow diagram of an embodiment of the method of populating a holding frame with a module according to the invention.

In the enclosed drawings and in the associated descriptions of said drawings, corresponding or related elements are given corresponding or similar reference signs, where expedient, even when they are to be found in different embodiments.

FIG. 1 shows a view of a holding frame according to a first embodiment of the invention, with modules, while FIG. 2 shows an enlarged detail of the view shown in FIG. 1, and FIG. 3 shows another enlarged detail of the view shown in FIG. 1.

Holding frame 1 is shown here with a module 9 already inserted and with another module 9 that is offset relative to the inserted module 9 in the opposite direction to the insertion direction.

Holding frame 1 comprises a base frame 111 that has two end faces 112 (only one of which is shown) and two side walls 113 (only one of which is shown).

Proceeding from its top edge, base frame 111 has three receptacles in each side wall 113 for receiving latching lugs 91 of modules 9, said receptacles being defined by a stop 114 and two opposite guides 115.

The number of receptacles shown is merely for illustrative purposes, and the invention is not limited in that respect, so other numbers of modules may be provided in holding frames according to the invention.

Guides 115 are provided with different spacing on opposite sides of base frame 111, such that a wider latching lug 91 of a module can be accommodated on the one side than on the opposite side. The allows protection against reversed polarity and against module 9 being inserted the wrong way round.

Side walls 113 each have a recess 116 on their inner sides. This recess 116 can also be described as having a smaller wall thickness in certain areas 116 when, as in this example, the outer side of side walls 113 is planar, with the result that a certain amount of free space exists along side wall 113 between side wall 113 and an inserted module 9.

This free space is bounded in the plane of side wall 113 by boundaries 117 at which the wall thickness increases, in the present example, in a shoulder or step to the thickness that the rest of side wall 113 has.

Below each receptacle (i.e. further in the insertion direction), each side wall 113 has an opening 118 that extends through it from the outer to the inner side and also has a section on the inner side of side wall 113 where the thickness of the wall is less.

In the region of each receptacle, there is also a fixing member 120 mounted on base frame 111.

Fixing member 120 comprises two fixing arms 121 that are connected to each other, namely in such a manner—in this embodiment—that the fixing member extends between boundaries 117 such that fixing member 120 is fixed in place by form-locking engagement in the plane defined by side wall 113 between boundaries 117 and fixing member 120. However, fixing arms 121 are able to move inside recess 116 when fixing member 120 is shaped accordingly.

Fixing member 120 is made of rectangular wire and in the middle has a clamping piece 122 that extends through the opening 118 in side wall 113 and on the outer side of the side wall, in the section with the reduced wall thickness, rests against the wall so that the fixing member is held in place on the side wall by the relative positioning of clamping piece 122 and the rest of fixing member 120.

At each of the ends of fixing arms 121 of fixing member 120, which extend in the direction opposite the insertion direction, there is a fixing hook 123 which is formed by bending the wire into an approximately triangular shape and which has a sloping face 124 and a shoulder 125. Between fixing arms 121, in particular between shoulders 125 and the stop 114 of the base frame, there is a latching area 126 for receiving the respective latching lug 91 of a module 9.

When module 9 is inserted into holding frame 1, each latching lug 91 comes between the guides 115 in base frame 111 and then arrives at the fixing hooks 123 of fixing arms 121 of the respective fixing member 120. Due to a certain amount of force exerted to continue insertion, fixing arms 121 are deformed by the latching lugs 91 that each slide along sloping faces 124, with fixing hooks 123 being moved laterally, in the sense of transversely, to module 9. When the respective latching lug 91 has completely passed fixing hook 123, there is no longer a force being exerted on fixing hooks 123 or fixing arms 121 to maintain the deformation of fixing arms 121, and the fixing arms spring back to a position as seen in FIG. 2, for example. It should be noted that plastic deformation is also possible, but in that case a user has to take appropriate action to return the fixing arms to their previous shape.

When a latching lug 91 of a module 9 is in latching area 126, shoulders 125 and stop 114 enclose the latching lug in such a way that it is not possible to move module 9 back and forth in the insertion, or only to a very limited extent. Due to guides 115 contacting latching lug 91, the latter is also fixed or almost fixed in the transversal direction to module 9 (the longitudinal direction of holding frame 1). When the inner sides of side walls 113 are correspondingly far apart, it is also possible to prevent or limit any movement of module 9 in its longitudinal direction, so that module 9 is fixed in three spatial directions.

Module 9 is releasably fixed in the holding frame if it is possible to act externally on fixing arms 121 to remove fixing hooks 123 in front of the latching lug 91 of the module (by bending fixing arms 121).

Shoulder 125 preferably slopes slightly upwards towards fixing arm 121, so that when a force is exerted in the opposite direction to the insertion direction on an inserted module 9, shoulder 125 comes to rest flatly on the surface of the latching lug, with a certain amount of deformation of fixing member 120, in order to better suppress any further unbending.

However, it is also possible that the shoulder slopes in the opposite direction so that the fixing arms can be unbent by exerting sufficient force and without damaging the holding frame.

FIG. 4 shows a view of a holding frame according to a second embodiment of the invention, with modules. FIG. 5 shows a side view of a detail of the holding frame shown in FIG. 4, and FIG. 6 shows an enlarged view of the holding frame shown in FIG. 4, without modules. FIG. 7 shows a partial cross-sectional view of the holding frame shown in FIG. 4, without modules, and FIG. 8 shows two views of a fixing member of the holding frame shown in FIG. 4.

Similar to the one in the first embodiment, holding frame 2 according to the second embodiment comprises a base frame 211 which has two end faces 212 and two side walls 213. Unlike in the first embodiment, holding frame 2 is designed to accommodate six modules 9 and to fix them in place using their latching lugs 91.

Similarly to the first embodiment, base frame 211 has respective guides 215 and stops 214 for receiving latching lugs 91.

In a modification of the first embodiment, recess 216 extends over almost the entire inner side of side wall 213, such that boundaries 217 can also be seen as protrusions.

As was also the case in the first embodiment, openings 218 are provided in each of side walls 213 to receive clamping sections 222 of fixing members 220.

As in the first embodiment, a fixing member 220 comprises two fixing arms 221 and a clamping piece 222, wherein fixing arms 221 define a latching area 226 between them and each have at their end a fixing hook 223 with a sloping face 224 and a shoulder 225.

With the exception of the number of modules 9 to be accommodated, and the design of the inner sides of side walls 213, the second embodiment substantially resembles the first embodiment, so reference is made to the foregoing for further details.

FIG. 9 shows a view of a holding frame according to a third embodiment of the invention, with modules, while FIG. 10 shows an enlarged detail of the view shown in FIG. 9, and FIG. 11 shows another enlarged detail of the view shown in FIG. 9.

As in the first embodiment, holding frame 3 of the third embodiment comprises a base frame 311 which has two end faces 312 and two side walls 313. Base frame 311 is identical in its main characteristics to the base frame 111 of the first embodiment.

As in in the first embodiment also, base frame 311 comprises respective guides 315 and stops 314 for receiving latching lugs 91, with a recess 316 being provided on the inner side of each side wall 313, with boundaries 317 for receiving fixing member 320. In the third embodiment also, openings 318 are provided in side walls 313 for receiving clamping pieces 322 of fixing members 320.

As in the first embodiment, a fixing member 320 comprises two fixing arms 321 and a clamping piece 322, wherein fixing arms 321 define a latching area 326 between them and each have a fixing hook 323 with a sloping face 324 and a shoulder 325. Unlike in the first embodiment, however, fixing hook 323 is not provided at the end of each fixing arm 321, because in this embodiment each fixing arm 321 is lengthened by a manipulation member 327.

Manipulation member 327 extends in the opposite direction to the insertion direction beyond an upper edge of base frame 311 and an upper edge of inserted module 9, so that a user can spread fixing members 320 apart to remove an inserted module 9 without needing separate tools.

With the exception of manipulation members 327 that have been added, the third embodiment is identical to the first embodiment, so reference is made to the foregoing for further details.

FIG. 12 shows a view of a holding frame according to a fourth embodiment of the invention, with modules, and FIG. 13 shows a side view of a detail of the holding frame shown in FIG. 12. FIG. 14 shows an enlarged view of the holding frame shown in FIG. 12, without modules, while FIG. 15 shows a partial cross-sectional view of the holding frame shown in FIG. 12, without modules, and FIG. 16 shows two views of a fixing member of the holding frame shown in FIG. 12.

Like in the second embodiment, the holding frame 4 of the fourth embodiment comprises a base frame 411 which has two end faces 412 and two side walls 413. Base frame 411 is identical in its main characteristics to the base frame 211 of the second embodiment.

As in the embodiment also, base frame 411 comprises respective guides 415 and stops 414 for receiving latching lugs 91, with an almost continuous recess 416 being provided on the inner side of each side wall 413, with boundaries or protrusions 417 for receiving fixing element 320. In the fourth embodiment also, openings 418 are provided in side walls 413 for receiving clamping pieces 422 of fixing members 420.

As in the second embodiment, a fixing member 420 comprises two fixing arms 421 and a clamping piece 422, wherein fixing arms 421 define a latching area 426 between them and each have a fixing hook 423 with a sloping face 424 and a shoulder 425. Unlike in the second embodiment, however, fixing hook 423 is not provided at the end of each fixing arm 421, because in this embodiment each fixing arm 421 is lengthened by a manipulation member 427.

Similarly to the third embodiment, manipulation member 427 extends in the opposite direction to the insertion direction beyond an upper edge of base frame 411 and an upper edge of inserted module 9, so that a user can spread fixing members 420 apart to remove an inserted module 9 without needing separate tools.

With the exception of manipulation members 427 that have been added, the fourth embodiment is identical to the second embodiment, so reference is made to the foregoing for further details.

FIG. 17 shows a view of a holding frame according to a fifth embodiment of the invention. FIG. 18 shows an enlarged detail of the view shown in FIG. 17, and FIG. 19 shows a view of a fixing member of the holding frame shown in FIG. 17.

The holding frame 5 of the fifth embodiment is shown in FIG. 17 without any modules inserted, although modules 9 as shown in the views of the embodiments above are likewise suitable and provided for insertion into holding frame 5.

This embodiment and the invention in general are not limited to such modules 9, however, and it should be obvious that the invention can also be used, for example, for modules that have the dimensions of a double module, i.e. which have two latching lugs on either side.

Holding frame 5 comprises a base frame 511 which has two end faces 512 and two side walls 312. Similarly to the embodiments already discussed in the foregoing, side walls 513 each have several combinations (in this case six) of guides 515 and a stop 514 for receiving a latching lug of a module.

In the region of one combination of guides 515 and stop 514, a fixing member is mounted on the inner side of each side wall 513.

Unlike in the embodiments above, the inner side of each side wall 513 has a clamping section 519 for each fixing member 520, which projects inwards from the inner side of side wall 513 and onto which fixing member 520 is clamped. The fixing member has a section that fits around clamping section 51 and which forms a force-fit connection with clamping section 519.

In this embodiment, fixing member 520 is made of an elastic plastic and—similarly to the embodiments above—has two fixing arms 521, at the ends of each that point away from the insertion direction a fixing hook 223 having a sloping face 524 and a shoulder 525 is arranged. Fixing arms 521 have a latch area 526 between them, defined in the installed state by the inner sides of fixing arms 512, shoulders 525 and stop 514, in which a latching lug of a module (not shown here) is received when inserted.

As an alternative to plastic, the fixing member can also be formed from wire, as in the embodiments above, whereby it is also possible for it to be punched or the like from metal plate.

As far as its manner of operation when inserting and holding modules is concerned, holding frame 5 is identical to the embodiments above, so reference is made to the foregoing in that regard.

FIG. 20 shows a view of a holding frame according to a sixth embodiment of the invention, with modules. FIG. 21 shows a side view of a detail of the holding frame shown in FIG. 20, and FIG. 22 shows an enlarged view of the holding frame shown in FIG. 20, without modules. FIG. 23 shows another enlarged view of the holding frame shown in FIG. 20, without modules, and FIG. 24 shows two views of a fixing member of the holding frame shown in FIG. 20.

The holding frame 6 of the sixth embodiment has a base frame 611 that has side walls 613 and end faces 612. In this embodiment, holding frame 6 is designed to receive six modules 9 (or three double modules), wherein modules 9 are each held in holding frame 6 by fixing members 620.

Proceeding from a bottom section of base frame 611, a plurality of protrusions extend in the opposite direction to the insertion direction, each of them widening at the end and having guides 615 there, along which a latching lug 91 of a module 9 is guided during insertion into holding frame 6. Each of the five protrusions provided in the middle region of each side wall 613 thus has a T-shape, whereas the protrusions at the end of side wall 613 have an inverted L-shape. The bottom section of base frame 611 also has a stop 614 for each latching lug 91, that limits the insertion depth.

Each fixing member 620 has two fixing arms 621, at the ends of each that point away from the insertion direction a fixing hook 623 is provided. Each fixing hook 623 has a sloping face 624 and a shoulder 625, the fixing arms and in particular shoulders 625 jointly determining with guides 615 and stop 614 a latching area 626 for receiving a latching lug 91.

Fixing members 620, which are made in this case of a round wire, are each held on base frame 611 by intertwining.

Proceeding from fixing hook 623, fixing arms 621 extend (in the installed state) firstly in the insertion direction to a height below stop 614, where the wire is bent in such a way that the path of fixing member 620 leads to stop 614. Stop 614 is designed in such a way that a slot in which fixing member 620 partly extends is formed between the inner side and the outer side of base frame 611. The wire of fixing member 620 reverses its direction there and runs at a height below stop 614 in the direction of the end faces 612 of base frame 611. Beyond the ends of the shanks of the protrusions having guides 615, the wire changes direction to the direction opposite the insertion direction, the wire of fixing member 620 passing the shanks on the outer side of base frame 611. Above base frame 611, fixing member 620 has a top bar 628, so that the fixing member is produced by a wire running continuously from fixing hook 623 to fixing hook 623.

Due to it switching from a path on the inner face of base frame 611 to a path on the outer side of base frame 611, and respective barriers are formed by elements of base frame 611, fixing member 620 is fixed in place in base frame 611.

With regard to the process of inserting a module 9 and to the details of how a latching lug 91 of module 9 is held in place, reference is made to the descriptions above.

FIG. 25 shows a partial cross-sectional view of a holding frame according to a seventh embodiment of the invention, with modules, and FIG. 26 shows another partial cross-sectional view of the holding frame shown in FIG. 25.

Holding frame 7 of the seventh embodiment comprises a base frame 711 that has end faces 712 and side walls 713. In the views shown in FIG. 25 and FIG. 26, holding frame 7 is shown in partial cross-section in the longitudinal direction, once with a view onto an inner side of side wall 713 (FIG. 25) and once with a view onto the outer side of side wall 713 (FIG. 26).

In the inner side of side wall 713, the latter has a plurality of clamping sections 719 in the form of recesses, for partly receiving a fixing member 720.

Unlike in the embodiments above, base frame 711 has a guide 715 only in its outer areas, in the longitudinal direction, with a continuous stop 714 otherwise provided between the guides.

Fixing members 720 are each clamped in their lower region into clamping sections 719 and have fixing arms 721 that extend in the installed state beyond stop 714 in the opposite direction to the insertion direction.

Similarly to the embodiments above, fixing arms 721 each have fixing hooks 723 having a sloping face 724 and a shoulder 725.

In comparison with the embodiments above, fixing members 720 are offset by half a module width, a respective latching area 726 then being defined between the fixing arms 721 of neighbouring fixing members 721 and bounded by stop 714 and fixing arms 723 with shoulders 725. The latching lug 91 of a module 9 enters this latching area 726 on insertion and is held in place there.

According to this different arrangement, the fixing hooks 723 of fixing members 720 are oriented outwards, based on the direction of side wall 713, so the respective fixing arm 721 is deformed during insertion towards the other fixing arm 721 of fixing member 720.

From the perspective of a latching lug 91 of a module 9, however, there are two neighbouring fixing hooks 723 facing each other that belong to two different fixing members 720 and which jointly hold an inserted latching lug 91 and thus fix module 9 in place.

Reference can thus be made here as well to the above discussion regarding the operation and the processes of inserting a module.

FIG. 27 shows a schematic flow diagram of an embodiment of the method of populating a holding frame with a module according to the invention.

The method according to the invention is used to populate a holding frame (as provided in the embodiments discussed above, for example), for a plug connector for receiving similar and/or different modules, with a module.

The method comprises a step S1 of inserting the module into a base frame. This base frame defines a plane transverse to an insertion direction of the module into the holding frame and has mutually opposite end faces and mutually opposite side walls (see above).

In one part of insertion step S2, a latching lug of the module passes (in step S2) a section of a fixing arm of a fixing member that is mounted on a side wall of the base frame and which is designed for deformation between an insertion state which allows the module to be inserted into the holding frame, and a holding state in which an inserted module is held in place, along the insertion direction at least, by the latching lug of the module and the fixing member.

In conjunction with insertion step S2, the section through which the latching lug passes is made to widen (step S3), thus resulting in the insertion state being reached (step S4).

The fixing member is in the insertion state (S4) for at least a moment during the passing step (S2).

After the passing step (S2), the method comprises the step of the fixing member springing back (step S5) from the insertion state to the holding state (step S6).

As already explained several times in the foregoing, the deformation step S5 (just like the widening step S3) includes movement of at least the fixing arm of the fixing member in the longitudinal direction of the side wall.

Once a module has been inserted and is held in the holding state, the method can be repeated for another module until the entire holding frame has been populated.

Even if different aspects or features of the invention are shown in combination in the Figures, it is clear to a person skilled in the art, unless otherwise specified, that the combinations shown and discussed are not the only ones possible. More particularly, it is possible to swap corresponding units or groups of features from different embodiments.

LIST OF REFERENCE SIGNS

1, 2, 3, 4, 5, 6, 7 Holding frame
9 Module
91 Latching lug
111, 211, 311, 411, 511, 611, 711 Base frame
112, 212, 312, 412, 512, 612, 712 End face
113, 213, 313, 413, 513, 613, 713 Side wall
114, 214, 314, 414, 514, 614, 714 Stop
115, 215, 315, 415, 515, 615, 715 Guide
116, 216, 316, 416 Recess
117, 217, 317, 417 Boundary
118, 218, 318, 418 Opening in side wall
519, 719 Clamping section
120, 220, 320, 420, 520, 620, 720 Fixing element
121, 221, 321, 421, 521, 621, 721 Fixing arm
122, 222, 322, 422 Clamping member
123, 223, 323, 423, 523, 623, 723 Fixing hook
124, 224, 324, 424, 524, 624, 724 Limb
125, 225, 325, 425, 525, 625, 725 Shoulder
126, 226, 326, 426, 526, 626, 726 Latching area
327, 427 Manipulation element

628 Top bar
S1 Insertion
S2 Passing
S3 Widening
S4 Insertion state
S5 Springing back
S6 Holding state

The invention claimed is:

1. A holding frame for a plug connector for receiving similar and/or different modules, comprising:

a base frame which defines a plane transverse to an insertion direction of a module into the holding frame and which has mutually opposite end walls and mutually opposite side walls extending between the mutually opposite end walls which define a frame interior through which the module is removably insertable to extend through the base frame, and a fixing member which is attached to a side wall of the base frame and which is designed for deformation between an insertion state which allows the module to be inserted into the holding frame in the insertion direction, and a holding state in which an inserted module is held in place, at least along the insertion direction, by a latching lug of the module and by the fixing member, wherein the fixing member is designed such that the deformation includes movement of at least one fixing arm of the fixing member in a longitudinal direction of the side wall that is perpendicular to the end walls and perpendicular to the insertion direction, and wherein the fixing member is mounted in a recess on an inner side of the side wall and is fixed in place in the insertion direction by boundaries of the recess, wherein the fixing member also includes a clamping piece that extends through an opening in the side wall and/or around an edge of the side wall to an outer side of the side wall and with which the fixing member is secured against falling out of the recess, or wherein the fixing member is clamped in place by a clamping section on an inner side of the side wall, or wherein the fixing member is arranged with parts on an outer side of the side wall and with parts on an inner side of the side wall and is intertwined with at least a part of the base frame.

2. The holding frame according to claim 1, wherein the fixing member includes a round or rectangular wire and/or an elastic plastic or spring steel strip.

3. The holding frame according to claim 1, wherein the base frame has a stop for the latching lug in the direction of insertion.

4. The holding frame according to claim 1, wherein the holding frame has a guide for guiding the latching lug on insertion of the module into the holding frame.

5. The holding frame according to claim 1, wherein the fixing arm has a fixing hook having a sloping face and a shoulder, wherein the sloping face is provided to come into contact with the latching lug of the module on insertion of the module, such that when the latching lug slides along the sloping face, the fixing arm is deformed in the direction of the insertion state, and wherein the shoulder is designed to engage at least partly with the latching lug of the inserted module in the holding state.

6. The holding frame according to claim 1, wherein the fixing arm has a manipulation member that projects beyond an upper edge of the base frame and/or of an inserted module and allows the fixing arm to be manually deformed.

7. A method of populating a holding frame for a plug connector for receiving similar and/or different modules with a module, said method comprising:

inserting the module into a base frame which defines a plane transverse to an insertion direction of the module into the holding frame and which has mutually opposite end faces walls and mutually opposite side walls extending between the mutually opposite end walls which define a frame interior through which the module is removably insertable to extend through the base frame, wherein the inserting includes passing a latching lug of the module past a section of a fixing arm of a fixing member that is attached to a side wall of the base frame and that is designed to allow deformation between an insertion state which allows the module to be inserted into the holding frame and a holding state in which an inserted module is held in place, at least along the insertion direction, by the latching lug of the module and by the fixing member, wherein the fixing member is in the insertion state for at least a moment during the passing, wherein the method includes deforming the fixing member from the insertion state to the holding state, and wherein the deforming includes movement of at least the fixing arm of the fixing member in a longitudinal direction of the side wall that is perpendicular to the end walls and perpendicular to the insertion direction.

* * * * *